US012751558B2

(12) United States Patent
Kirchhoff

(10) Patent No.: US 12,751,558 B2
(45) Date of Patent: Oct. 6, 2026

(54) TEMPERATURE REGULATING FOAM PADDING WITH PASSIVE COOLING AND ACTIVE HEATING

(71) Applicant: VARIOWELL DEVELOPMENT GMBH, Münster (DE)

(72) Inventor: Tobias Kirchhoff, Münster (DE)

(73) Assignee: VARIOWELL DEVELOPMENT GMBH, Münster (DE)

( * ) Notice: Subject to any disclaimer, the term of this patent is extended or adjusted under 35 U.S.C. 154(b) by 119 days.

(21) Appl. No.: 18/719,348

(22) PCT Filed: Nov. 17, 2022

(86) PCT No.: PCT/EP2022/082283
§ 371 (c)(1),
(2) Date: Jun. 13, 2024

(87) PCT Pub. No.: WO2023/110279
PCT Pub. Date: Jun. 22, 2023

(65) Prior Publication Data

US 2025/0057325 A1 Feb. 20, 2025

Related U.S. Application Data

(63) Continuation of application No. 17/550,403, filed on Dec. 14, 2021.

(30) Foreign Application Priority Data

Dec. 14, 2021 (LU) ..... 501010

(51) Int. Cl.
*A47C 21/04* (2006.01)
*A47C 27/14* (2006.01)

(52) U.S. Cl.
CPC ..... *A47C 21/048* (2013.01); *A47C 21/046* (2013.01); *A47C 27/14* (2013.01)

(58) Field of Classification Search
CPC ..... A47C 21/048; A47C 21/046; A47C 27/14; A47C 21/003
See application file for complete search history.

(56) References Cited

U.S. PATENT DOCUMENTS 4,043,544 A * 8/1977 Ismer ..... B60N 2/5635 297/452.47
6,794,030 B1 * 9/2004 Okada ..... H01L 23/3737 428/423.7

(Continued)

FOREIGN PATENT DOCUMENTS

CN 107713481 A 2/2018
CN 107772906 A 3/2018

(Continued)

OTHER PUBLICATIONS

Raymann et al., Cutaneous Warming Promotes Sleep Onset, Am J Physiol Regul Integr Comp Physiol, Jan. 27, 2005, R1589-R1597, vol. 288, American Physiological Society.

(Continued)

*Primary Examiner* — Myles A Throop
(74) *Attorney, Agent, or Firm* — Hudak, Shunk & Farine Co. LPA

(57) ABSTRACT

A temperature regulating foam padding including a plurality of zones, at least one passive cooling device, disposed in at least a first zone of the plurality of zones, at least one heating device, disposed in at least the first zone, at least one temperature sensor and/or heart rate sensor, disposed in the first zone, and a controller, connected to the heating device and the sensor(s) for controlling the heating device. The passive cooling device is adapted to lower the temperature of the first zone to a first temperature (T1) below a desired (Continued)

temperature (T) and the heating device is adapted to increase the temperature of the first zone from the first temperature (T1) to the desired temperature (T).

16 Claims, 7 Drawing Sheets

(56) References Cited

U.S. PATENT DOCUMENTS

2003/0052121 A1* 3/2003 Sopory ..... H05B 3/60 219/535
2003/0109908 A1* 6/2003 Lachenbruch ..... A61F 7/02 5/690
2005/0288749 A1* 12/2005 Lachenbruch ..... A61F 7/10 607/108
2007/0135878 A1* 6/2007 Lachenbruch ..... A47C 27/002 607/108
2010/0325796 A1* 12/2010 Lachenbruch ..... A61F 7/02 5/422
2011/0041246 A1* 2/2011 Li ..... A47C 27/122 219/490
2019/0320808 A1* 10/2019 Chapin ..... A47C 21/044
2021/0244192 A1 8/2021 Kirchhoff
2021/0267382 A1* 9/2021 Aou ..... C09D 171/02
2023/0099583 A1* 3/2023 Kirchhoff ..... A47C 27/14 5/678
2023/0180940 A1* 6/2023 Kirchhoff ..... A47C 21/046 5/421

FOREIGN PATENT DOCUMENTS

KR 1020210035133 A 3/2021
WO 2006001980 A2 1/2006
WO WO-2015034528 A1 * 3/2015 ..... A47C 21/046
WO WO-2019238420 A1 * 12/2019 ..... A47C 21/046

OTHER PUBLICATIONS

Bowman, et al., Characterizing the Human Heart Rate Circadian Pacemaker through Widely Available Wearable Devices, preprint, Mar. 12, 2020, pp. 1-23, BioRxiv.
yt5s.com—Can This $3,500 Smart Bed Improve Your Sleep? A Sleep Expert Tests It Out WSJ—(480p) https://www.youtube.com/watch?v=0m2s8R9QVW8, Dec. 3, 2021.

* cited by examiner

TEMPERATURE REGULATING FOAM PADDING WITH PASSIVE COOLING AND ACTIVE HEATING

CROSS-REFERENCE TO RELATED APPLICATIONS

This application claims benefit of and priority to LU Patent Application No. LU501010 filed on 14 Dec. 2021 and of U.S. patent application Ser. No. 17/550,403 filed on 14 Dec. 2021.

FIELD OF THE INVENTION

The field of the invention relates to a foam padding for e.g., a mattress.

BACKGROUND OF THE INVENTION

There is a trend in the mattress industry to develop mattresses which seek to alleviate overheating during use of the mattress or provide higher thermal comfort during sleep for a user by regulating the temperature of the mattress.

Thermal comfort in sleep is defined as a temperature environment that can promote an enhanced sleep experience. The temperature of the mattress needs to be regulated or adjusted to provide thermal comfort to the user of the mattress. A suitable temperature for the mattress may vary between different zones of the mattress and may change with time depending on different sleep phases of the user.

Mattresses have been proposed which use active cooling techniques with a cooling fluid or a heating fluid or using forced air to regulate the temperature of the mattress. These approaches have, however, proven to be unpractical and energy-intensive (see, for example, Wall Street Journal: Can This $3,500 Smart Bed Improve Your Sleep? A Sleep Expert Tests It Out | WSJ, 2021, [YouTube] https://www.youtube.com/watch?v=0m2s8R9QVW8, 05:00-06:00). Other mattresses have been proposed using passive cooling techniques by integrating phase-change-materials, graphite-infused foams, gel-infused foams or other passive cooling elements into the mattress.

However, the passive cooling technique does not enable control of the degree of cooling to adjust and vary the temperature of the mattress. These technologies store thermal energy without removing the thermal energy and therefore provide only an instant and short-lived cooling effect in the showroom or for onset of sleep.

The Chinese patent application CN 107 772 906 A describes a cold/warm dual-purpose temperature regulating mat with two layers, i.e., a high temperature layer and a low temperature layer. The two layers are separately provided with a phase-changing energy storage module of different phase changing temperatures. The phase changing temperature of the phase changing material used in the high temperature layer is higher than that of the phase changing material used in the low temperature layer.

The Chinese patent application CN 107 713 481 A describes an office chair with a temperature regulation function. The office chair comprises a chair seat, a chair back hinged to the chair seat, and an electric control system including a temperature sensor. The chair seat comprises a so-called "skeleton" and a bladeless fan arranged in the skeleton. A heating pad is arranged above the skeleton.

The Korean patent application KR 2021/0035133 A describes a temperature control mattress using a micro-heating element. The temperature control mattress uses the micro-heating element having a new structure which is configured to provide a pleasant sleeping space to a user and block inhabitation of dust mites.

The international patent application WO 2006/001980 A2 describes a support surface without requiring external power or circulation of air for steady-state cooling of the skin. Heat is transferred via a thermally conductive layer or layers of material(s) that are soft, pliable, and comfortable to sit or lie on. The layer is connected to conductive materials that transport heat and diffuse the heat to a cooler environment.

The US patent application US 2021/244192 A1 describes a foam padding having sections. The padding includes a flexible elongated band for transferring thermal energy from at least one hollow volume in a first one of said sections in the event of excess thermal energy towards at least one hollow volume in a second section in the padding not containing excess thermal energy.

The prior art does not describe a foam padding which provides adjustable cooling without the need for expensive and energy-intensive active cooling devices.

SUMMARY OF THE INVENTION

The invention describes a foam padding that regulates the temperature by a combination of passive cooling and active heating. A foam padding is provided comprising a plurality of zones according to one aspect of the invention. At least one passive cooling device is disposed in at least a first zone of the plurality of zones. At least one heating device is disposed in at least one of the zones. At least one temperature sensor or one heart rate sensor is further disposed in the first zone. The foam padding further comprises a controller for controlling the heating device. The controller is connected to the heating device and the temperature sensor and/or the heart rate sensor. The passive cooling device is constructed to enable passive lowering of the temperature of the first zone to a first temperature below a desired temperature. The heating device is adapted to increase the temperature of the first zone from the first temperature to the desired temperature.

The passive cooling device enables lowering of the temperature of the foam padding without the need for complex, expensive and energy-consuming active cooling-devices. The temperature is lowered to the first temperature which cannot be adjusted during operation of the foam padding and which is lower than the temperatures usually preferred by a user. The temperature of the foam padding can be increased to the desired temperature by combining the passive cooling with the needed amount of heating by the heating device. The temperature of the foam padding can therefore be individually lowered to the desired temperature without the need for active cooling devices.

The passive cooling device can further be a conductive band connecting at least the first zone and a second zone of the plurality of zones. The conductive band is adapted to transport thermal energy between the first zone and the second zone.

The conductive band can further be adapted for transporting thermal energy generated by the heating device between the first zone and the second zone.

The heating device can further be a warming band for increasing the temperature of the first zone.

The first zone can further have excess thermal energy.

The second zone can further have no excess thermal energy.

The conductive band can further transport thermal energy from the first zone to the second zone.

The flow of thermal energy transported by the conductive band from the first zone to the second zone can further be substantially equal to the flow of thermal energy emitted by a user of the padding into the first zone.

The heating device can further be supplied by a low-voltage power supply.

The flow of thermal energy from the heating device into the first zone can further be smaller than the flow of thermal energy to the passive cooling device.

The foam padding can further be in the form of a mattress or a seat.

The conductive band can further comprise a continuous conductive layer extending from within the first zone to the second zone.

A method for regulating the temperature of a foam padding is further described. The foam padding comprises a plurality of zones and at least one heating device disposed in at least one of the plurality of zones. The foam padding further comprises at least one sensor, disposed in at least the first zone, and a controller, connected to the heating device and the at least one sensor. The foam padding further comprises at least one passive cooling device for lowering the temperature of the first zone to a first temperature below a desired temperature. The method comprises the step of measuring the temperature in the first zone, using the temperature sensor, and/or measuring the heart rate or heart rate variability using the heart rate sensor. The method further comprises the step of controlling the heating device to reach and hold the desired temperature in the first zone, using the controller.

DETAILED DESCRIPTION OF THE INVENTION

Figure 1:
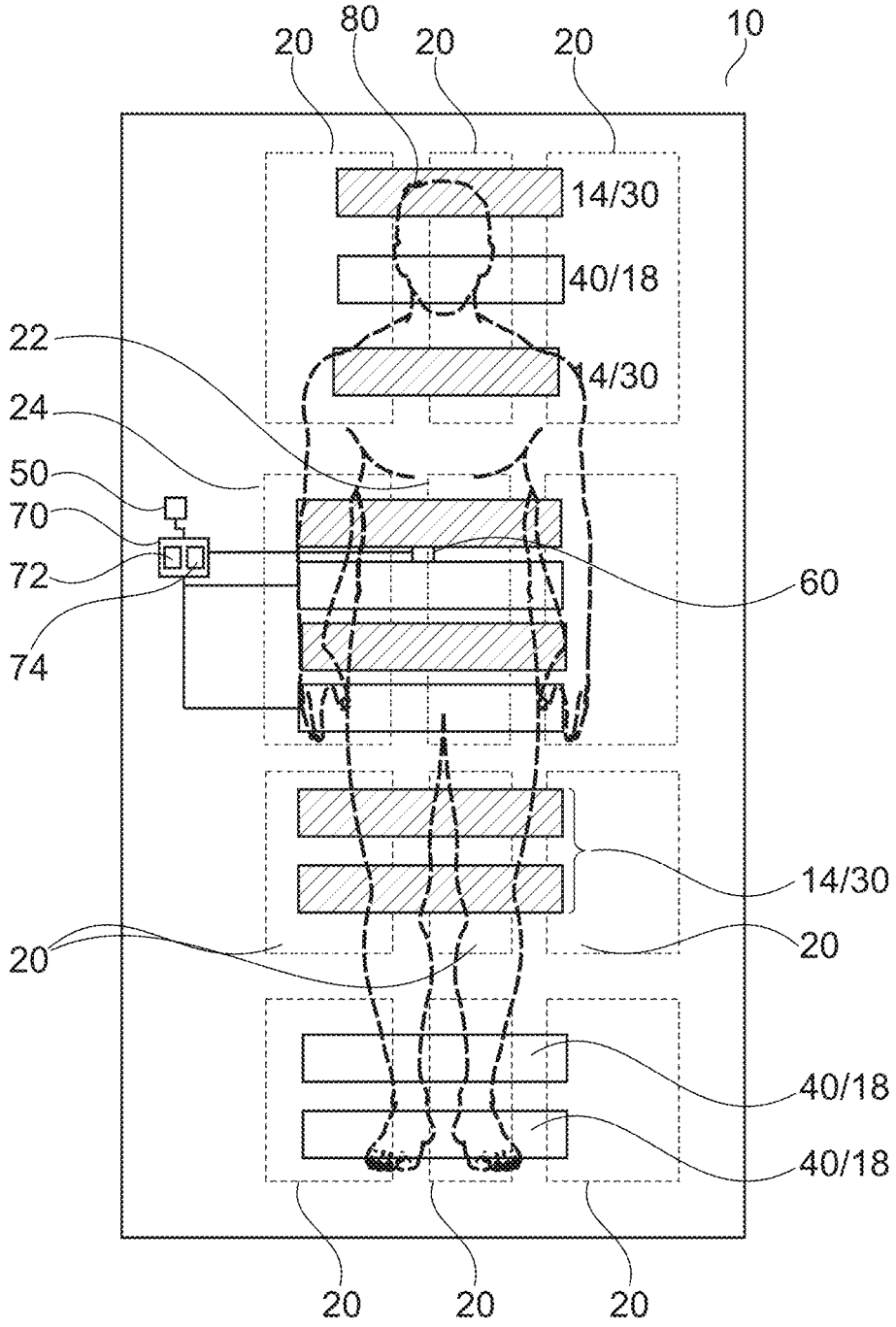
FIG. 1 shows a top view of a padding according to a first aspect of the invention.

The invention will now be described on the basis of the figures. It will be understood that the embodiments and aspects of the invention described herein are only examples and do not limit the protective scope of the claims in any way. The invention is defined by the claims and their equivalents. It will be understood that features of one aspect or embodiment of the invention can be combined with a feature of a different aspect or aspects and/or embodiments of the invention.

The following description discloses a mattress as an aspect of the foam padding and a method for regulating the temperature of the mattress.

Thermal comfort in sleep is defined as a temperature environment that can promote, for example, faster onset of sleep and less interrupted sleep. The faster onset of sleep and the degree of interruption of the sleep are both parameters of sleep experience. The temperature of the mattress is one of the parameters influencing thermal comfort, in addition to the ambient air temperature. The comfort for the user of a mattress while using the mattress can be enhanced by enhancing the thermal comfort.

It is known that a warmer sleep climate, such as a warmer mattress temperature, when going to bed can enhance the onset of sleep. Blood circulation and stress-free thermal regulation of body heat can be stimulated additionally if there is an increased temperature gradient between torso and leg/arm of the user of the mattress (see, for example, "Cutaneous warming promotes sleep onset", Roy J. E. M. Raymann, Dick F. Swaab, and Eus J. W. Van Someren, American Journal of Physiology-Regulatory, Integrative and Comparative Physiology 2005 288:6, R1589-R1597). The increase in the temperature gradient between different body parts of the user can be established if the mattress can adjust the temperatures of different zones of the mattress independently from each other.

After onset of sleep, in a first sleep phase, a core body temperature of the user is still high, like in daytime. Use of insulating comforters can prevent the body of the user from emitting this heat. A cooler sleep climate with a reduced mattress temperature can be useful in the first sleep phase to enhance the sleep experience.

The core body temperature of the user decreases during sleep. This phase can be defined as a second sleep phase following the first sleep phase. The start of the second sleep phase can be precisely determined by measuring core body temperature. Alternative parameters such as the heart rate of the user can be used instead, as the core body temperature of the user is not easy to measure (see, for example, "Characterizing the Human Heart Rate Circadian Pacemaker through Widely Available Wearable Devices", Bowman, Clark & Huang, Yitong & Walch, Olivia & Fang, Yu & Frank, Elena & Goldstein, Cathy & Sen, Srijan & Forger, Daniel, 2020, DOI: 10.1101/2020.03.12.988899). The sleep experience of the user decreases if the body temperature of the user drops too much. The body may need some additional heating to retain a comfortably feeling in specific ones of the zones of the mattress. Provision of a small degree of heating to the body can, in one aspect, be in a lumbar region of the user's body in this second sleep phase.

A wake-up phase is the third sleep phase and follows the second sleep phase. The temperature of the mattress in the wake-up phase can influence the length of the sleep and the comfort that a user might experience at wake-up.

The thermal comfort during the sleep of the user of the mattress can therefore be increased by adjusting the temperature of the mattress independently for different ones of the zones of the mattress and varying the temperature over time. This temperature variation might depend on the sleep phase. The temperature of the mattress and/or of the different ones of the zones of the mattress therefore needs to be adjustable to enhance the sleep experience of the user of the mattress.

Adjusting the temperature of the mattress or ones of the zones of the mattress can be achieved by removing body heat by passive cooling, for example by using passive cooling devices integrated into the mattress. It is possible, however, that the mattress comprises so many of the passive cooling devices that the body temperature drops too much with the result that the user of the mattress would feel cold.

In another aspect, the temperature of the mattress is not just decreased using the passive cooling devices but is also increased by applying adjustable heating using heating devices, whereas the passive cooling devices themselves are not adjustable. The temperature of the mattress in this aspect can be adjusted to a desired temperature. Techniques for applying the adjustable heating are much less complex and consume less energy than devices for adjustable cooling.

The adjustable heating can be applied to ones of the zones of the mattress if the passive cooling decreases the temperature of the mattress to an extent that the user sleeping would feel too cold or that the temperature of the mattress falls below a temperature suitable for maintaining the thermal comfort of the user. The heating devices integrated into the mattress can be used to apply the adjustable heating in an energy-saving manner. The temperatures in the zones of the mattress can be set by controlling the emittance of thermal energy from the heating devices using temperature sensors and a controller. The desired temperatures for the different zones of the mattress can be set independently from each other and can be varied with time. The controller controls the heating devices depending on the temperatures of the zones of the mattress. The zone temperature is measured by the temperature sensors in the different zones of the mattress. Further parameters such as e.g., the heart rate (or heart rate variability) of the user of the mattress measured by a heart rate sensor can be taken into account by the controller for controlling the heating devices.

The zone temperatures can therefore be adjusted to specific temperatures without the need of applying the adjustable cooling techniques. Examples of adjustable cooling techniques include ventilation of the mattress or air-conditioning devices incorporated into the mattress. The combination of the passive cooling devices with the heating devices enables the development of a temperature regulating mattress at lower costs and with less complex components.

The temperature of any material is the result of $$T(Mat@t) = T(Mat@t-1) + E(therm-inflow) - E(therm-outflow)$$

T (Mat@t) is the temperature of a given material at a given time t. T (Mat@t−1) is the temperature of this given material before this given time t. E (therm-inflow) is the thermal energy reaching the given material between times t−1 and t and E (therm-outflow) is the thermal energy leaving the given material between t−1 and t. Based on this assumption, a change of the temperature is not done by changing the temperature of the given material itself but rather analyzing and optimizing the thermal energy flows affecting the given materials.

The inflow of the thermal energy E (therm-inflow) to the given material in the mattress has to be lowered or the outflow of the thermal energy E (therm-inflow) has to be raised to lower the temperature in the given material permanently. Most of the inflow of the thermal energy E (therm-inflow) in a typical mattress is from the impact of the body heat of the user on the mattress. The body during the sleep phases emits a heat flux of 40 W/m2 skin. Approximately 70-80 W/user translates to an inflow of the thermal energy E (therm-inflow) of 230 kJ per night. There is no realistic method to reduce the inflow of the thermal energy into the mattress. The outflow of thermal energy from the zone with the excess thermal energy to the zone without excess thermal energy thus needs to be increased to decrease the temperature of the mattress.

The thermal energy emitted from the body of the user is not distributed homogenously throughout the mattress. The thermal energy emitted by the body is collected in the foam of a padding in a first zone with the excess thermal energy being just below the body of the user. This first zone starts 3 cm to 7 cm below the surface of the mattress that is in contact with the body of the user of the mattress and reaches up to 15 cm below the surface, depending on the foam structure and/or shape. A temperature gradient within the mattress occurs as the temperature of the foam of the mattress around the first zone is similar to the ambient air temperature and not the body temperature. A zone that is around the first zone and that is more like the ambient air temperature is termed a "second zone". The mattress therefore has a temperature gradient between the first zone and the second zone in directions substantially parallel to the plane of the surface of the mattress. The second zone can be near an edge or at the bottom of the mattress or in any other zone in which the user does not feel the higher temperature.

A long-lasting cooling effect can be provided by transporting the thermal energy away to those zones of the mattress at which the user of the mattress does not feel the heat due to the thermal energy, such as in the second zone. The temperature gradient between the first zone and the second zone allows this transportation of the thermal energy to the second zone. The thermal energy due to the body heat starts to accumulate in the first zone around 10-20 minutes after the user of the mattress started using the mattress. The cooling effect due to the transporting of the thermal energy to the second zone starts around this time. The effect of transporting the thermal energy is continuous during the use of the mattress. The resulting temperature gradient will drive the transport of the thermal energy as long as the body emits the body heat.

Flexible materials can be used for the passive cooling devices. The passive cooling devices using flexible materials can adapt to the elastic deformation of the mattress that is caused by the weight of the user of the mattress. The passive cooling devices can thereby be incorporated into the padding of the mattress without reducing the comfort feeling. These passive cooling devices do not require external energy. The passive heating devices can be used to transport the excess thermal energy from the first zone to the second zone.

The passive cooling devices utilize, for cooling the first zone or the other zones, a property of mostly foam based mattresses that the thermal energy is not distributed evenly within the mattress. Polyurethane foam typically has many hollow volumes (usually called cells) which are either open (connected to each other) or closed (not connected to each other). The hollow volumes contain air which gradually becomes warmer with use. The movement of the air is very restricted even in the open cell foams and the air moves upwards towards, but not away from, the user. The foam has a low thermal conductivity. The foam material cannot transport the thermal energy very well or rather not at all.

The passive cooling devices can be designed as conductive bands, as this is a form which is flexible in two dimensions. The conductive bands have an electrically conductive layer and have therefore a high thermal conductivity. Materials such as materials with carbon content, like graphite or graphene, can be used. Other materials, such as but not limited to aluminum, could be used for the conductive layer. The thickness of the conductive layer is below 0.5 mm to provide flexibility, but greater thickness is also allowed as long as a certain flexibility is maintained. The conductive layer within the conductive band is uninterrupted.

The conductive band is positioned in a way that the conductive band touches the hollow volumes in the zones with the excess thermal energy, i.e., directly under the body or any of the heating devices and at the same time also touches at least one hollow volume in a zone without excess thermal energy without any interruption of the conductive layer. These zones can be found in the mattress, e.g., in towards or at the edges of the mattress. The zones without the excess thermal energy can also be located at the bottom surface of the mattress if air can reach and cool the bottom surface of the mattress (e.g., by using a slated frame or a spring box).

There are two principles driving the transport of the thermal energy along the conductive band between the different zones within the mattress.

1. The greater the difference of the thermal energy between the different zones, the greater the flow of the thermal energy. As noted above, the amount of the thermal energy below the body is substantially constant and thus a search for the zones with lower values of the thermal energy is carried out.
2. The greater the area of the conductive band in the zone of the mattress without excess thermal energy in relation to the area of the conductive band in the zone of the mattress with excess thermal energy, the greater the thermal energy flow. At least 30% of the conductive band is in one aspect in the zone without excess thermal energy, and in a further aspect 50% is used, in the case of a lower temperature difference.

The temperature of larger ones of the zones of the mattress can be decreased by integrating more than one of the conductive bands. Different cooling characteristics can be desirable for different ones of the zones below different ones of the parts of the body of the user. Less thermal energy may be needed to be transported away from the zone below the area of the feet, compared to the zone below the hip or the lumbar region, for example. The different cooling characteristics, such as different transport rates for the thermal energy, can be achieved for different ones of the zones of the mattress by varying the number and the dimensions (such as the thickness) of the conductive bands between the zones.

The conductive band described should have a thickness between 0.1 mm to 0.5 mm. A thin conductive band is more flexible but also more sensitive to break whereas a thicker conductive band is the opposite. A capacity of the conductive band to absorb and transport the thermal energy can be affected by the thickness of the band. The conductive band was observed to fit well into the mattress if the width is between 4 cm to 10 cm, though also smaller or wider dimensions are allowed.

A laminating of a very thin layer of stabilizing material such as polyethylene (<0.18 mm thickness) can prevent the break of the conductive band if exposed to punctual impact. The thin lamination layer can, of course, also be applied on both sides of the conductive band, but usually this is not necessary. Other material adding stability can be applied as the lamination layer to the band as long as the band is flexible i.e., polyurethane.

The conductive band can be positioned purely within the mattress. The conductive band can also run from the zone of the excess thermal energy along a side or the lower edge of the mattress or completely outside of the mattress (i.e., from the mattress into the spring box below). Typically, the outside thermal energy level is determined by the ambient air temperature which is typically much lower than the temperature of the zones of the excess thermal energy within the mattress.

The amount of the thermal energy that is transported from the zone with the excess thermal energy (like the first zone) to the zone without the excess thermal energy (like the second zone) using the conductive bands is dependent from the number and the dimensions of the conductive bands, the temperatures in the zones and the positioning of the conductive bands between the zones. The cooling of the zones of the mattress using the conductive bands thus cannot be actively controlled. One or more of the heating devices can be used to adjust the temperature of the zones of the mattress. If the temperature of ones of the zones drops below a desired temperature for the zones at that moment, additional thermal energy can be emitted actively into the zones using the heating devices to reach the desired temperature.

The heating devices can be heating elements that convert electrical energy into the thermal energy by the process of Joule heating. Other kinds of the heating devices could also be used to emit the thermal energy into the mattress.

The heating devices can be designed as a warming band, as this is a form which is flexible in both dimensions. The warming band can comprise a heating element material that emits the thermal energy if a voltage is applied to the material. Suitable heating element materials can be such as, but not limited to metals like Nichrome (nickel, chromium and other element, e.g., iron, alloys) or Kanthal® (iron-chromium-aluminum alloys), ceramic materials and semiconductors like molybdenum disilicide or silicon carbide or polymer materials like PTC rubber.

The warming bands can have a woven textile layer coated with an electrically conductive coating. The electrically conductive coating can be made of polyurethane that is blended with conductive materials such as carbon black. The electrically conductive coating can cover the entire surface of the warming band. Electrically conductive fibers can be woven into the woven textile layer on opposite edges of the warming band. Electrical current can flow from the woven electrically conductive fibers on the one side of the warming band through the electrically conductive coating to the woven electrically conductive fibers on the other side of the warming band. Electrical energy is converted into thermal energy by the process of Joule heating. This thermal energy is created immediately once the electrical current is applied to the warming band. The warming band stops to emit the thermal energy as soon as the current is interrupted. The warming band is flexible and can be glued between foam layers of the foam padding.

The warming bands are supplied by an energy supply that can be directly connected to the warming bands and that can be integrated into the mattress or that can be positioned outside of the mattress. The power supply can be a battery or a power supply unit that is connected to the power grid. Warming bands that can emit the required amount of thermal energy and run on a low voltage such as, but not limited to 12V can be used to achieve an energy-saving operation of the mattress. The power supply in this case is a low-voltage power supply.

The temperature of the larger zones of the mattress can be adjusted by integrating more than one of the warming bands. Different heating characteristics can be desirable for different ones of the zones below the different parts of the body of the user. More thermal energy may be needed to be emitted to the zone below the feet, compared to the zone below the hip or the lumbar region, for example. The different heating characteristic, such as different heating rates or maximum temperatures, can be achieved for different ones of the zones of the mattress by varying the number and properties (such as the dimensions or the voltage) of the warming bands between the zones.

The warming bands can be integrated into the mattress or can alternatively be positioned outside of the mattress such as being attached to an outer surface of the mattress.

It is helpful to know the exact temperature of the zones to adjust the temperature of the zones of the mattress. One or more temperature sensors can be integrated into ones of the zones of the mattress to measure the temperature within the zones. The temperature sensors can also be positioned outside of the mattress to measure the surface temperature of the mattress. The temperature sensors can measure the temperature within the foam of the foam padding. This temperature is influenced by the passive cooling devices and the heating devices. Other parameters such as the ambient air temperature and the body heat emitted by the user also influence the temperature within the foam.

The parameters that cannot be influenced, such as the ambient air temperature or the heat emitted by the user, are taken into account by measuring the actual temperature within the foam padding. Typical temperature values in the zone below the body are 30° C., 32° C. or 34° C. The temperature can be as high as 40° C. if the user desires a lot of additional warmth is desired or as low as 28° C. if the user desires a 'cool' sleep experience. 28° C. is experienced by the user as 'cool' since it is much lower than the body temperature of 36° C.

A controller is connected to one or more of the temperature sensors and one or more of the warming bands. The controller can be connected to the same power supply as used for the warming bands or to a separate power supply that is integrated into the mattress or positioned outside of the mattress. The controller can receive the measured temperatures from the one or more temperature sensors. The controller can further control the one or more warming bands to control the amount of the thermal energy emitted by the warming bands. The temperature sensors and the warming bands that are connected to the controller can be positioned in one or more of the zones of the mattress.

The controller can adjust the temperature of the one or more of the zones following a simple logic like adjusting the temperature to the desired temperature and maintaining the desired temperature. The controller can alternatively use more complex logic, like varying the temperatures between different ones of the zones of the mattress and varying the temperatures with time dependent on the sleep phase of the user of the mattress. The logic can be stored on the controller, or the controller can have a wired or wireless connection to an external computing device, such as a smartphone. The external computing device is able to send instructions on how to control the temperatures within the mattress or on which of the stored logics to use to the controller. The controller or the external computing device can use further input parameters for adjusting the temperatures within the mattress. For example, the heart rate and/or heart rate variability of the user of the mattress can be received by the controller or by the external computing device from a heart rate sensor, such as a smart watch. Data input by the user can also be considered for controlling the temperatures within the mattress.

An example for the logic for controlling the temperatures inside the mattress is described as follows. Warmer temperatures of the mattress at the time at which the user goes to bed enhance a quicker onset of sleep, as noted above. The controller can thus increase the temperatures of the zones of the mattress before the user goes to bed. The user may input their desired go-to-bed time using the smartphone or the smartwatch to ensure that there is sufficient time for the heating and to avoid inefficient heating long before the actual go-to-bed time.

The temperatures of different ones of the zones at e.g., the go-to-bed time can further be adjusted to different values to stimulate blood circulation and stress-free thermal regulation of the body. The controller can therefore adjust the temperature of the zone or zones below the legs and feet of the user to a higher temperature than the zone below the hip or lumbar region.

The core body temperature is still high, like in daytime, after the onset of sleep in the first sleep phase. The controller can instruct the warming bands to gradually diminish the active heating in the first sleep phase to avoid uncomfortably high temperatures for the user. The passive cooling by the conductive bands prevails over the active heating in the first sleep phase.

The second sleep phase is characterized by a decrease of the body temperature of the user. The controller can control the warming bands to support the body to retain a comfortable temperature. The warming bands can heat actively ones of the zones of the mattress such as the zone or zones below the legs or feet or the zone below the lumbar region.

The third sleep phase, i.e., the wake-up phase, precedes the waking of the user. There are different options for controlling the temperatures in the mattress during the third sleep phase. The heating in the zone or zones below the legs and/or feet and the zone below the lumbar region as carried out in the second sleep phase continues if prolonged sleeping is desired by the user, like on a weekend. The user may want to choose a cooling phase just before wake-up to support a comfortable wake-up, in case of a wake-up time on a weekday. The active heating during the third sleep phase is, in this case, decreased or diminished to reduce the temperatures in the mattress by the prevailing passive cooling. It is also possible to heat the mattress to a higher temperature before the wake-up time to disturb the sleep of the user for an easier wake-up.

The user can set their preferred option for the third sleep phase as well as the preferred wake-up time using the smartphone or the smartwatch. The controller could also learn the sleeping habits of the user using artificial intelligence algorithms and therefore automatically choose the preferred options. The controller can run the logic for adjusting the temperatures in the mattress automatically once the user once chose the preferred options. Further manual input is not required in this case.

EXAMPLES

FIG. 1 shows a top view of a padding 10 according to a first aspect of the invention. The padding 10 is in the form of a mattress but can be also in the form of a seat or any other form. The padding 10 has several zones 20. The head zones 20 of the padding 10 in the top of the figure are the zones 20 where the head of a user 80 of the padding 10 will be placed. The feet zones 20 of the padding 10 in the bottom of the figure are the zones 20 where the feet of the user 80 will be placed.

Several passive cooling devices 14 are integrated into the padding 10 to provide passive cooling. The passive cooling devices 14 have the shape of conductive bands 30 connecting at least two of the zones 20. The conductive bands 30 connect the middle zones 20 that are in the middle of the padding 10 in width direction to edge zones 20 that are closer to edges of the padding 10.

A first zone 22 is located in the middle of the padding 10. A second zone 24 is located between the first zone 22 and one of the edges of the padding 10. The body heat of the user 80 lying on the padding 10 is primarily emitted into the first zone 22 which is located directly below the user 80. The first zone 22 has therefore an excess amount of the thermal energy. The second zone 24 will in this case have no excess amount of the thermal energy, as the edges of the padding 10 are not affected by the body of the user 80 and the emittance of the thermal energy. There is a temperature gradient between the first zone 22 and the second zone 24. The first zone 22 is connected by one or more conductive bands 30 to the second zone 24. The conductive bands 30 extend from within the first zone 22 to within the second zone 24. The conductive bands 30 can transport the thermal energy between the first zone 22 and the second zone 24 because of the temperature gradient between the first zone 22 and the second zone 24.

Several heating devices 18 are further integrated into the padding 10. The heating devices 18 have the shape of the warming bands 40. The warming bands 40 have an orientation parallel to the conductive bands 30 but can also have a different orientation. Several ones of the warming bands 40 are positioned in the first zone 22. The warming bands 40 that are positioned in the first zone 22 also extend into the second zone 24.

The warming bands 40 are connected to a controller 70 which is integrated into the padding 10. A temperature sensor 60 is further integrated into the padding 10 in the first zone 22 to measure the temperature in the first zone 22. There can also be more than one of the temperature sensors 60 integrated into the first zone 22 and/or others of the zones 20. The number and positioning of the temperature sensors 60 can be varied. The temperature sensor 60 is also connected to the controller 70. The controller 70 is further connected to a low-voltage power supply 50.

In a further aspect, a heart rate sensor 65 for measuring the heart rate or heart-rate variability of the user can be integrated into the padding into the first zone 22 and/or others of the zones 20. Alternatively, the heart rate sensor 65 is attached to the user and could be, for example, a smart watch. The heart rate sensor 65 is also connected to the controller 70.

The controller 70 has a processing unit 72 that can control the emittance of thermal energy by the warming bands 40 to adjust the temperature in the first zone 22. The controller 70 is able to control more than one of the warming bands 40 in more than one of the zones 20 independently from each other, taking into account the temperatures in more than one of the zones 20. The controller 70 in this case receives the temperatures in the zones 20 from several of the temperature sensors 60. The controller 70 further comprises a memory unit 74 that can store a program that implements the logic of how to control the one or more of the warming bands 40 depending on the temperatures measured by the temperature sensor 60 and also using measurement of the heart rate and/or heart rate variability using the heart rate sensor 65. The memory unit 74 can also store more than one program. The controller 70 can have further interfaces to e.g., a smartphone, a smartwatch, or further sensors like a heart rate sensor to receive further parameters like the heart rate of the user 80. These further parameters can be taken into account by the processing unit 72 to control the warming bands 40.

The conductive bands 30 and the warming bands 40 are arranged in an uneven distribution in the padding 10. The conductive bands 30 and the warming bands 40 nevertheless are in one aspect substantially evenly distributed in ones of the zones 20. The conductive bands 30 and the warming bands 40 are arranged alternating in these zones 20. The zones 20 with the even distribution of the conductive bands 30 and the warming bands 40 can provide the passive cooling as well as the active heating. The temperature in such zones 20 can be adjusted to a desired temperature. Some of the parts of the body of the user 80 require both the passive cooling and the active heating during the different sleep phases to enhance sleep experience, like e.g., the head or the shoulders. The even distribution of the conductive bands 30 and the warming bands 40 can be chosen for those ones of the zones 20 that are below these parts of the body of the user 80.

The conductive bands 30 and the warming bands 40 are distributed unevenly in other ones of the zones 20. In some of the zones 20 there are only the conductive bands 30 and none of the warming bands 40. These kinds of zones 20 only provide the passive cooling. The temperature in these zones 20 can only be decreased by the passive cooling but cannot be adjusted actively. It can be sufficient for some of the parts of the body of the user 80 to provide only the passive cooling during the different sleep phases to enhance the sleep experience, like e.g., the head, hip, or legs. The zones 20 with only the conductive bands 30 can be placed below these parts of the body of the user 80.

The padding 10 also comprises ones of the zones 20 with only the warming bands 40 and none of the conductive bands 30. These kinds of zones 20 only provide the active heating. The temperature in these zones 20 can only be increased by the active heating but cannot be decreased by the passive cooling. It is feasible to place these kinds of zones 20 below the parts of the body of the user 80 for which it can be sufficient to provide only the active heating during the different sleep phases to enhance the sleep experience, like e.g., the feet.

Other kinds of distribution of the conductive bands 30 and the warming bands 40 can be chosen if desired or needed to meet specific cooling and heating requirements of different ones of the zones 20 of the padding 10. One of the zones 20 could e.g., contain both the conductive bands 30 and the warming bands 40 but in an uneven number and distribution.

Figure 2:
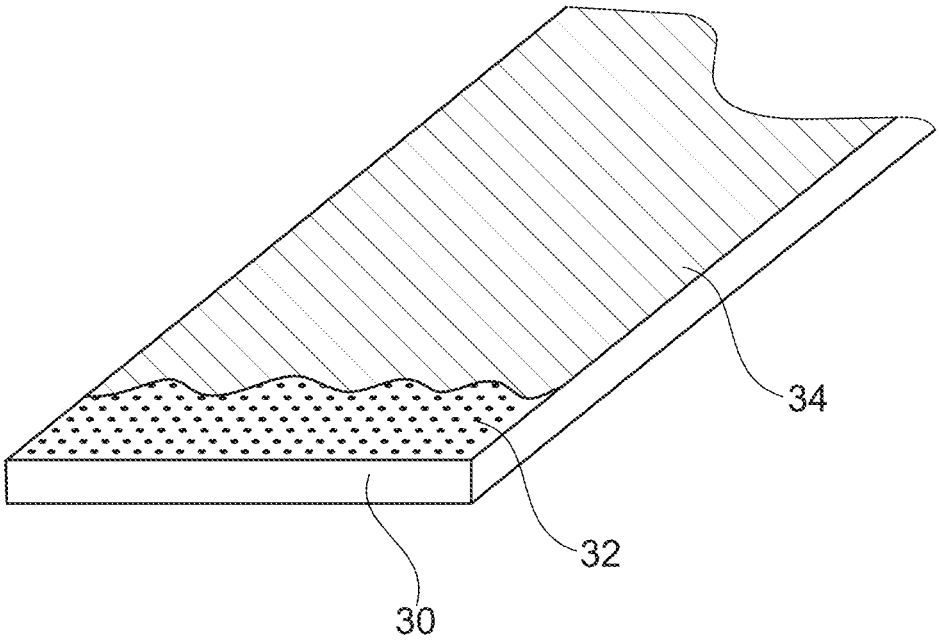
FIG. 2 shows a conductive band according to the invention in a schematic illustration.

FIG. 2 shows a conductive band 30 according to the invention in a schematic illustration. The conductive band 30 comprises a continuous conductive layer 32 being laminated with a layer of stabilizing material 34 along the whole length and width of the conductive band 30 to stabilize the conductive layer 32. The stabilizing material 34 can be e.g., polyethylene.

Figure 3:
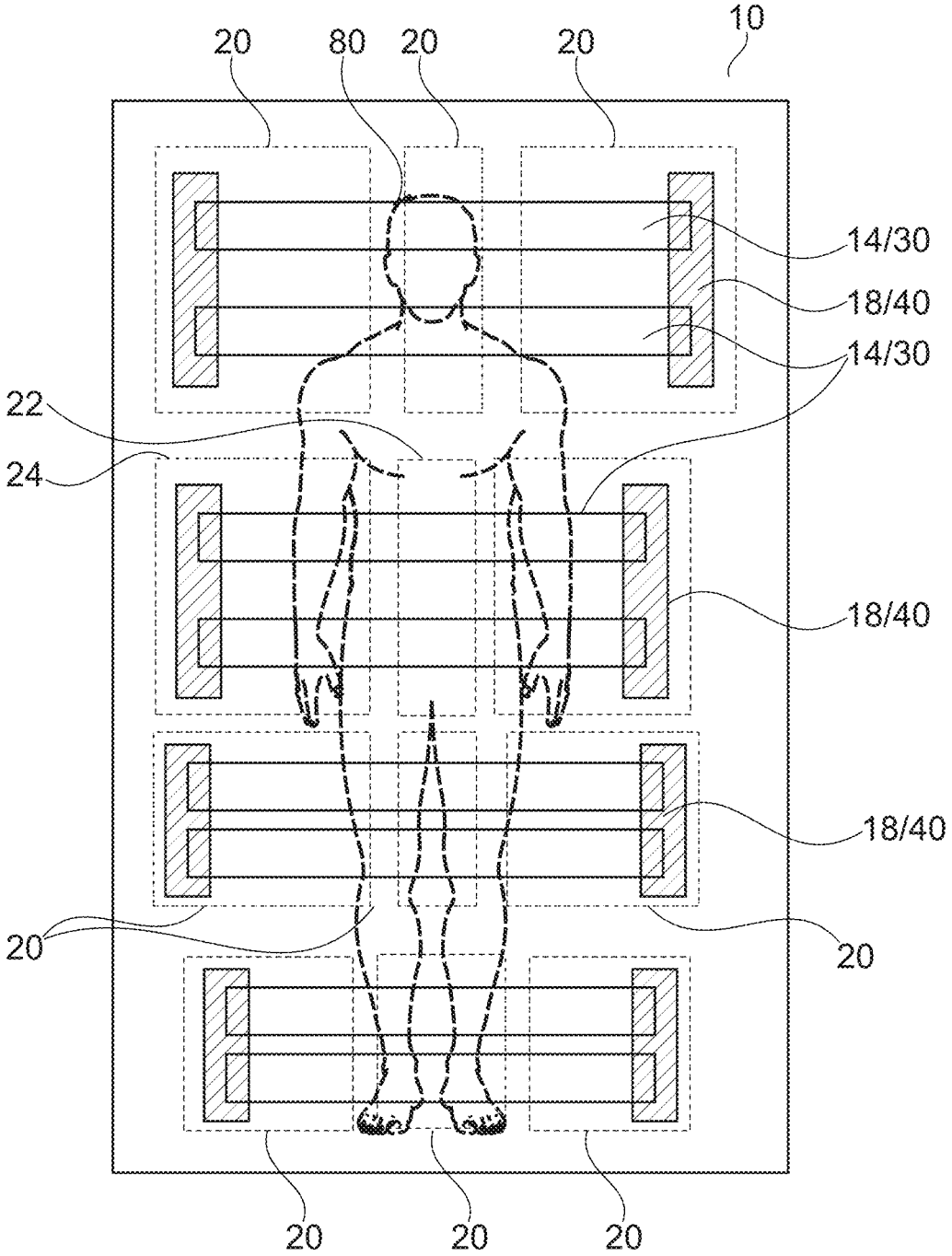
FIG. 3 shows a top view of a padding according to a second aspect of the invention.

FIG. 3 shows a top view of a padding 10 according to a second aspect of the invention. The padding 10 comprises several conductive bands 30 and several warming bands 40. The padding 10 according to the second aspect of the invention comprises the same components as the padding 10 according to the first aspect of the invention. Not all of the components are again depicted and described for the padding 10 according to the second aspect of the invention. The padding 10 according to the second aspect of the invention rather shows another option for arranging the conductive bands 30 and the warming bands 40 within the padding 10.

The conductive bands 30 connect the zones 20 of the padding 10 that are in the middle of the padding 10 in width direction to the zones 20 that are closer to edges of the padding 10. The first zone 22 is connected by the conductive bands 30 to a second zone 24. The conductive bands 30 extend from within the first zone 22 to within the second zone 24. The conductive bands 30 can transport thermal energy between the first zone 22 and the second zone 24 in case of a temperature gradient between the first zone 22 and the second zone 24.

The warming bands 40 have an orientation perpendicular to the conductive bands 30 but can alternatively also have a different orientation. One of the warming bands 40 is positioned in the second zone 24 such that the warming band 40 overlaps with parts of the conductive bands 30. None of the warming bands 40 is located in the first zone 22.

Excess thermal energy will arise in the second zone 24 if the warming bands 40 emit thermal energy. The temperature gradient between the second zone 24 and the first zone 22 therefore occurs. The conductive bands 30 transport the excess thermal energy that is emitted by the warming bands 40 from the second zone 24 to the first zone 22. The first zone 22 is passively cooled by the conductive bands 30 and actively heated by the warming bands 40 and the conductive bands 30. The temperature of the first zone 22 can thus be adjusted by controlling the warming bands using a controller 70 and a temperature sensor 60 that is placed in the first zone 22. The controller 70, the temperature sensor 60 and the low-voltage power supply 50 are the same as in the first aspect of the invention shown in in FIG. 1 and are therefore not depicted in FIG. 3 and not described at this point.

Figure 4:
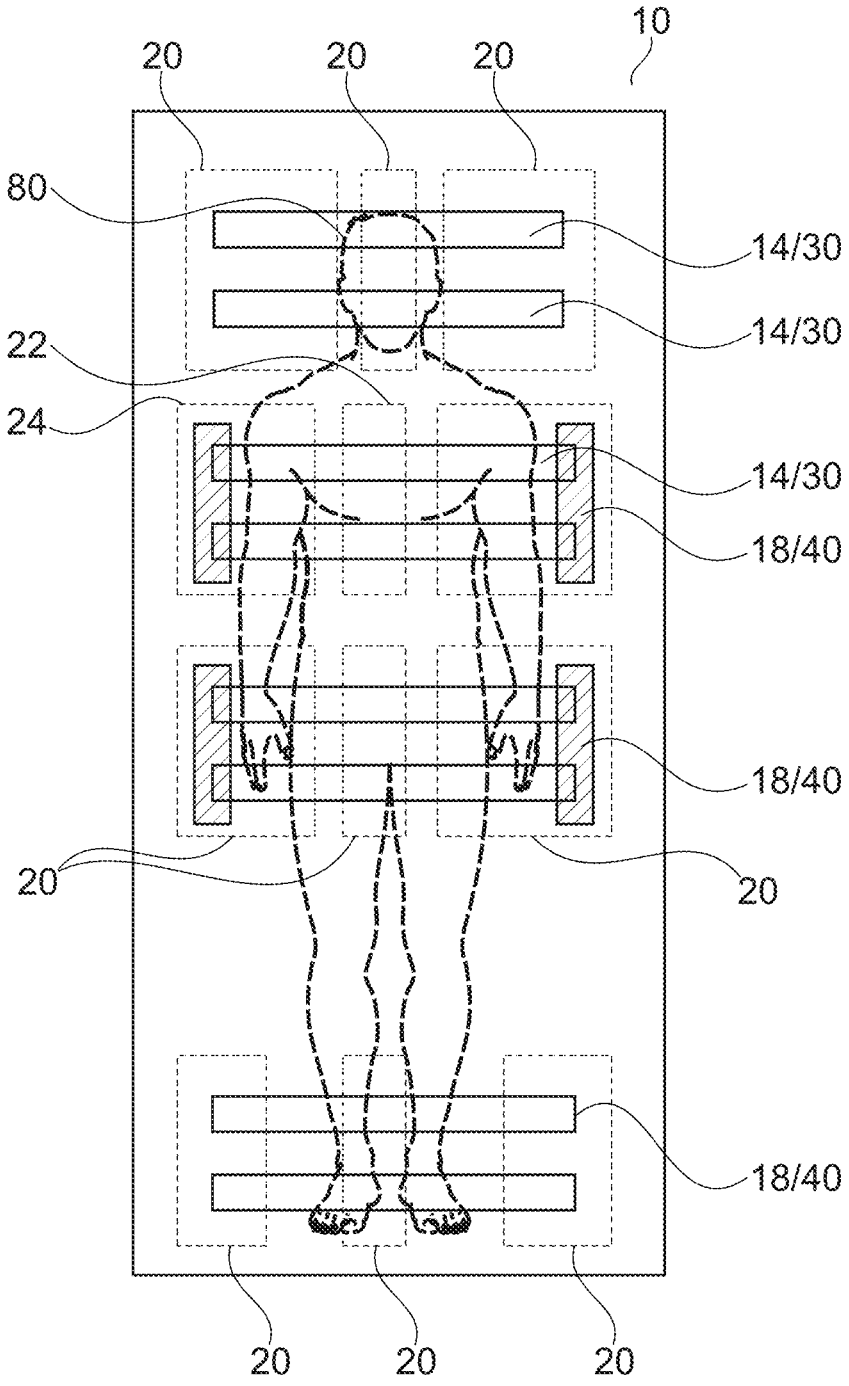
FIG. 4 shows a top view of a padding according to a third aspect of the invention.

FIG. 4 shows a top view of a padding 10 according to a third aspect of the invention. The padding 10 comprises several conductive bands 30 and several warming bands 40. The padding 10 according to the third aspect of the invention comprises the same components as the padding 10 according to the first aspect of the invention. Not all of the components are again depicted and described for the padding 10 according to the third aspect of the invention. The padding 10 according to the third aspect of the invention rather shows another option for arranging the conductive bands 30 and the warming bands 40 within the padding 10.

In some of the zones 20 of the padding 10 there are only the conductive bands 30 and none of the warming bands 40. These kinds of the zones 20 only provide passive cooling. The temperature in these zones 20 can only be decreased by the passive cooling but cannot be adjusted actively. It can be sufficient for some of the parts of the body of the user 80 to provide only the passive cooling during the different sleep phases to enhance the sleep experience, like e.g., the head, hip, or legs. The zones 20 with only the conductive bands 30 can be placed below these kinds of parts of the body of the user 80.

The padding 10 also comprises ones of the zones 20 with only the warming bands 40 and none of the conductive bands 30. These kinds of zones 20 only provide active heating. The temperature in these zones 20 can only be increased by the active heating but cannot be decreased by the passive cooling. It can be sufficient for some of the parts of the body of the user 80 to provide only the active heating during the different sleep phases to enhance the sleep experience, like e.g., the feet. The zones 20 with only the warming bands 40 can be placed below these kinds of parts the body of the body of the user 80.

The padding 10 comprises further ones of the zones 20 with an arrangement of the conductive bands 30 and the warming bands 40 as described for FIG. 3. These zones can be controlled separately to provide the passive cooling or the active heating to those zones 20 and the parts of the body of the user 80 that are placed above these zones 20.

Figure 5:
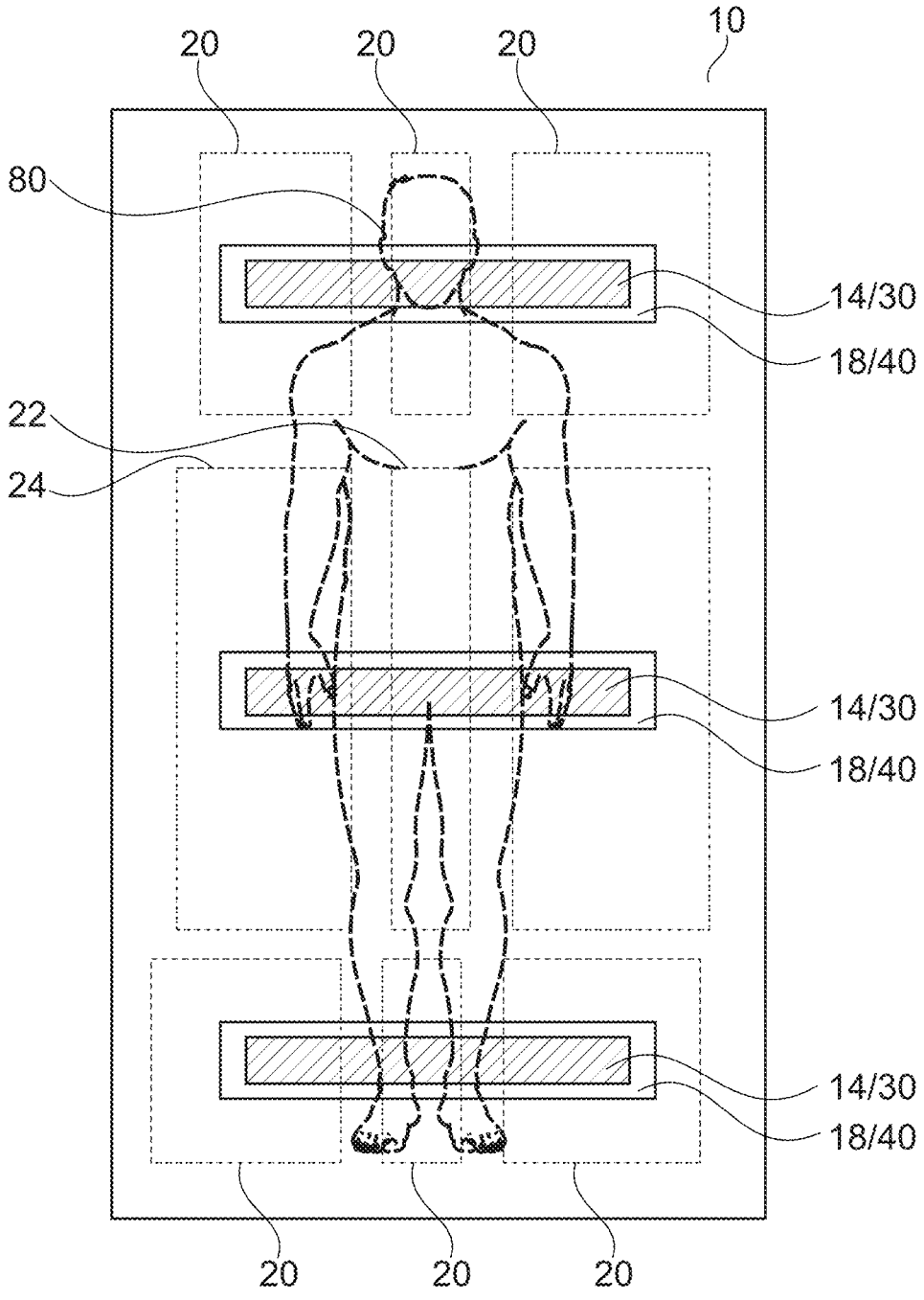
FIG. 5 shows a top view of a padding according to a fourth aspect of the invention.

FIG. 5 shows a top view of a padding according to a fourth aspect of the invention. The padding 10 comprises several conductive bands 30 and several warming bands 40. The padding 10 according to the fourth aspect of the invention comprises the same components as the padding 10 according to the first aspect of the invention. Not all components are again depicted and described for the padding 10 according to the third aspect of the invention. The padding 10 according to the fourth aspect of the invention rather shows another option for arranging the conductive bands 30 and the warming bands 40 within the padding 10.

The conductive bands 30 connect the zones 20 of the padding 10 that are the middle of the padding 10 in width direction to the zones 20 that are closer to edges of the padding 10. A first zone 22 is connected by the conductive bands 30 to the second zone 24. The conductive bands 30 extend from within the first zone 22 to within the second zone 24. The conductive bands 30 can transport thermal energy between the first zone 22 and the second zone 24 in case of the temperature gradient between the first zone 22 and the second zone 24.

The warming bands 40 have an orientation parallel to the conductive bands 30 but can alternatively also have a different orientation. The warming bands 40 are arranged below the conductive bands 30, such that at least parts of ones of the conductive bands 30 overlap with parts of ones of the warming bands 40. The warming bands 40 can have a length that is substantially equal to the length of the conductive bands 30. The width of the warming bands 40 can be larger than the width of the conductive band 40.

The conductive bands 30 provide passive cooling as long as the warming bands 40 do not emit thermal energy. The warming bands 40 provide active heating if the warming bands 40 emit thermal energy. The temperature in the zones 20 can therefore be adjusted by controlling the warming bands 40. The conductive bands 30 can enhance an equal distribution of the thermal energy emitted by warming bands 40 in the case of the active heating.

Figure 6:
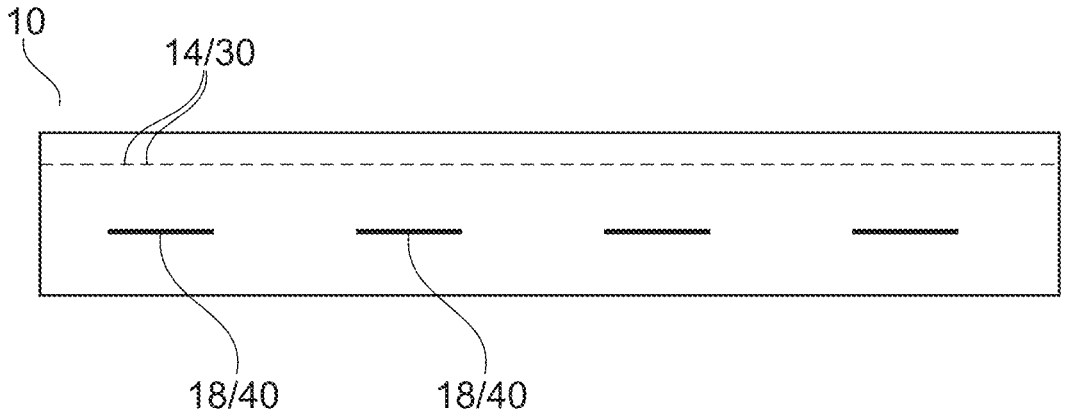
FIG. 6 shows a side view of a padding according to the fourth aspect of the invention.

FIG. 6 shows a side view of a padding 10 according to the fourth aspect of the invention. The surface of the padding 10 on top of the figure is the surface a user 80 of the padding 10 will lie on. The warming bands 40 are arranged below the conductive bands 30 withing the padding 10.

Figure 7:
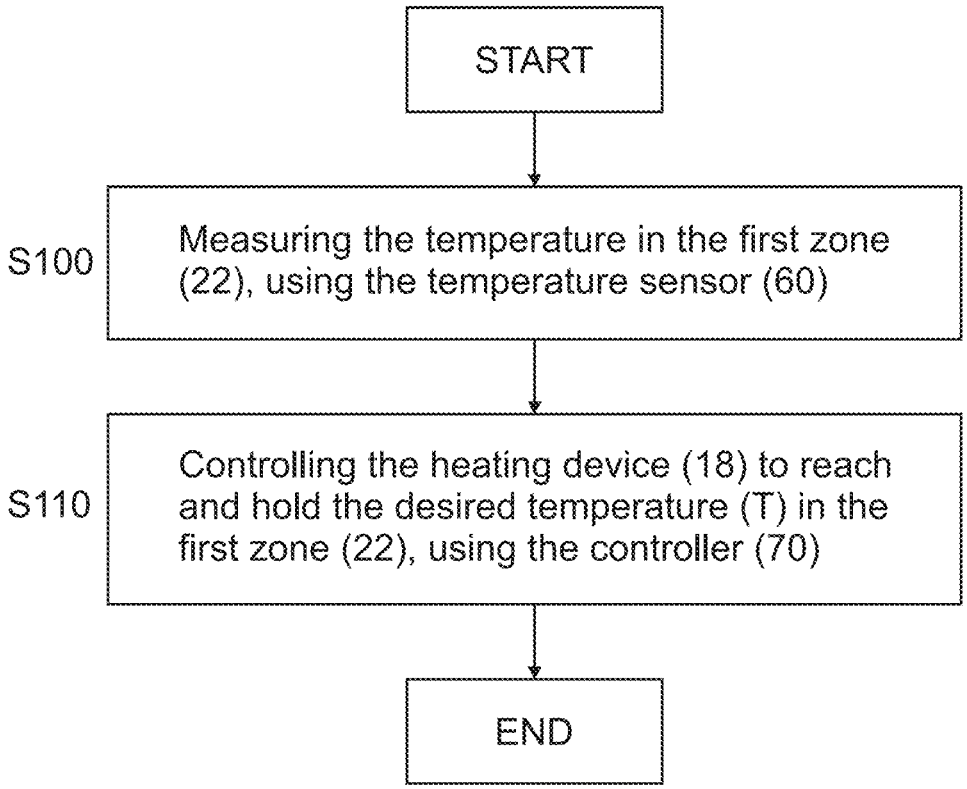
FIG. 7 shows a flow chart illustrating a method for regulating the temperature of a padding according to the invention.

FIG. 7 shows a flow chart illustrating a method for regulating the temperature of a padding 10 according to the invention. The temperature in a first zone 22 of the padding 10 is measured in step S100, using a temperature sensor 60 that is located in the first zone 22. A heating device 18 is controlled in step 110 by a controller 70 to reach and hold a desired temperature T in the first zone 22.

REFERENCE NUMERALS

10 Padding
14 Passive cooling device
18 Heating device
20 Zone
22 First zone
24 Second zone
30 Conductive band
32 Conductive layer
34 Stabilizing material
40 Warming band
50 Low-voltage power supply
60 Temperature sensor
65 Heart rate sensor
70 Controller
72 Processing Unit
74 Memory Unit
80 User
T1 First temperature
T Desired temperature
S100 Measuring the temperature in the first zone
S110 Controlling the heating device

What is claimed is:

1. A temperature regulating foam padding comprising:
a plurality of zones;

at least one passive cooling device, disposed in at least a first zone of the plurality of zones;

at least one heating device, disposed in at least one of the plurality of zones;

at least one sensor, disposed in the first zone; and a controller, connected to the heating device and the at least one sensor for controlling the heating device;

wherein the passive cooling device is adapted to lower the temperature of the first zone to a first temperature (T1) below a desired temperature (T); and the heating device is adapted to increase the temperature of the first zone from the first temperature (T1) to the desired temperature (T), wherein the passive cooling device is not adjustable and cannot be actively controlled; and wherein the heating device is controlled by the controller to compensate for a decrease of the temperature in the first zone below the desired temperature (T) caused by the passive cooling device.

2. The temperature regulating foam padding according to claim 1, where in the at least one sensor is a temperature sensor or a heart-rate sensor.

3. The temperature regulating foam padding according to claim 1, wherein the passive cooling device is a conductive band connecting at least the first zone and a second zone of the plurality of zones, the conductive band for transporting thermal energy between the first zone and the second zone.

4. The temperature regulating foam padding according to claim 3, wherein the conductive band is adapted for transporting thermal energy generated by the heating device between the first zone and the second zone.

5. The temperature regulating foam padding according to claim 3, wherein the second zone has no excess thermal energy.

6. The temperature regulating foam padding according to claim 3, wherein the conductive band transports thermal energy from the first zone to the second zone.

7. The temperature regulating foam padding according to claim 3, wherein the flow of thermal energy transported by the conductive band from the first zone to the second zone is substantially equal to the flow of thermal energy emitted by a user of the padding into the first zone.

8. The temperature regulating foam padding according to claim 3, wherein the conductive band comprises a continuous conductive layer extending from within the first zone to the second zone.

9. The temperature regulating foam padding according to claim 1, wherein the heating device is a warming band for increasing the temperature of the first zone.

10. The temperature regulating foam padding according to claim 1, wherein the first zone has excess thermal energy.

11. The temperature regulating foam padding according to claim 1, wherein the heating device is supplied by a low-voltage power supply.

12. The temperature regulating foam padding according to claim 1, wherein the flow of thermal energy from the heating device into the first zone is smaller than the flow of thermal energy to the passive cooling device.

13. The temperature regulating foam padding according to claim 1, wherein the foam padding is in the form of a mattress or a seat.

14. Use of the temperature regulating foam padding according to claim 1 in a bed.

15. A method for regulating the temperature of a foam padding, the foam padding comprising a plurality of zones, at least one heating device disposed in at least one of the plurality of zones, at least one sensor, disposed in at least the first zone, a controller, connected to the heating device and the at least one sensor, and at least one non-adjustable passive cooling device for lowering the temperature of the first zone to a first temperature (T1) below a desired temperature (T), the method comprising the steps of:

measuring parameters in the first zone using the at least one sensor;

allowing the at least one non-adjustable passive cooling device to lower the temperature of the first zone to a first temperature below the desired temperature (T); and controlling the heating device to compensate for the decrease of the temperature in the first zone below the desired temperature (T) caused by the passive cooling device and to increase and hold the temperature in the first zone at the desired temperature (T), using the controller.

16. The method of claim 15, wherein the at least one sensor is one of a temperature sensor, wherein the parameters measured are temperature, or a heart-rate sensor, wherein the parameters measured are at least one of a heart rate or a heart rate variability.

* * * * *